US005125581A

United States Patent [19]

Kronberger

[11] Patent Number: 5,125,581

[45] Date of Patent: Jun. 30, 1992

[54] FUEL INJECTION NOZZLE

[75] Inventor: Maximilian Kronberger, Steyr, Austria

[73] Assignee: Voest-Alpine Automotive Gesellschaft m.b.H., Linz, Austria

[21] Appl. No.: 573,020

[22] PCT Filed: Jan. 12, 1990

[86] PCT No.: PCT/AT90/00006

§ 371 Date: Nov. 7, 1990

§ 102(e) Date: Nov. 7, 1990

[87] PCT Pub. No.: WO90/08257

PCT Pub. Date: Jul. 26, 1990

[30] Foreign Application Priority Data

Jan. 12, 1989 [DE] Fed. Rep. of Germany ..... 3900762
Jan. 12, 1989 [DE] Fed. Rep. of Germany ..... 3900763

[51] Int. Cl.[5] ..... F02M 61/16
[52] U.S. Cl. ..... 239/533.5
[58] Field of Search ..... 239/88-92, 239/533.1-533.8

[56] References Cited

U.S. PATENT DOCUMENTS 2,279,010 4/1942 Nichols ..... 239/533.8
4,928,886 5/1990 Kronberger ..... 239/533.5

FOREIGN PATENT DOCUMENTS 0277939 8/1988 European Pat. Off. .
840481 6/1952 Fed. Rep. of Germany .
55362 3/1986 Japan ..... 239/533.5
2140505 11/1984 United Kingdom ..... 239/533.5

OTHER PUBLICATIONS

Patent Abstracts of Japan—vol. 10, No. 218 (M-503) (2274), Jul. 30, 1986 and JP-A-61 (Isuzu Motors Ltd.), Mar. 19, 1986.

*Primary Examiner*—Andres Kashnikow
*Assistant Examiner*—Lesley D. Morris
*Attorney, Agent, or Firm*—Cushman, Darby & Cushman

[57] ABSTRACT

A fuel injection nozzle, including a pressure chamber, an accumulator chamber in communication with the pressure chamber and a spring-loaded shunting piston limiting the volume of the accumulator chamber. The spring-loaded shunting piston has first and second ends and a cylindrical guide portion, the first end facing the accumulator chamber and including a guide extension with grooves. The cylindrical guide portion has a diameter to height ratio of 1:0.1 to 1:0.04. The second end of the shunting piston includes a pin of variable cross section which protrudes into a throttle opening of a plate which defines a damping chamber adapted to be filled with fluid, the spring-loaded shunting piston being influenced by pressure in the damping chamber.

9 Claims, 5 Drawing Sheets

FUEL INJECTION NOZZLE

Figure 1:
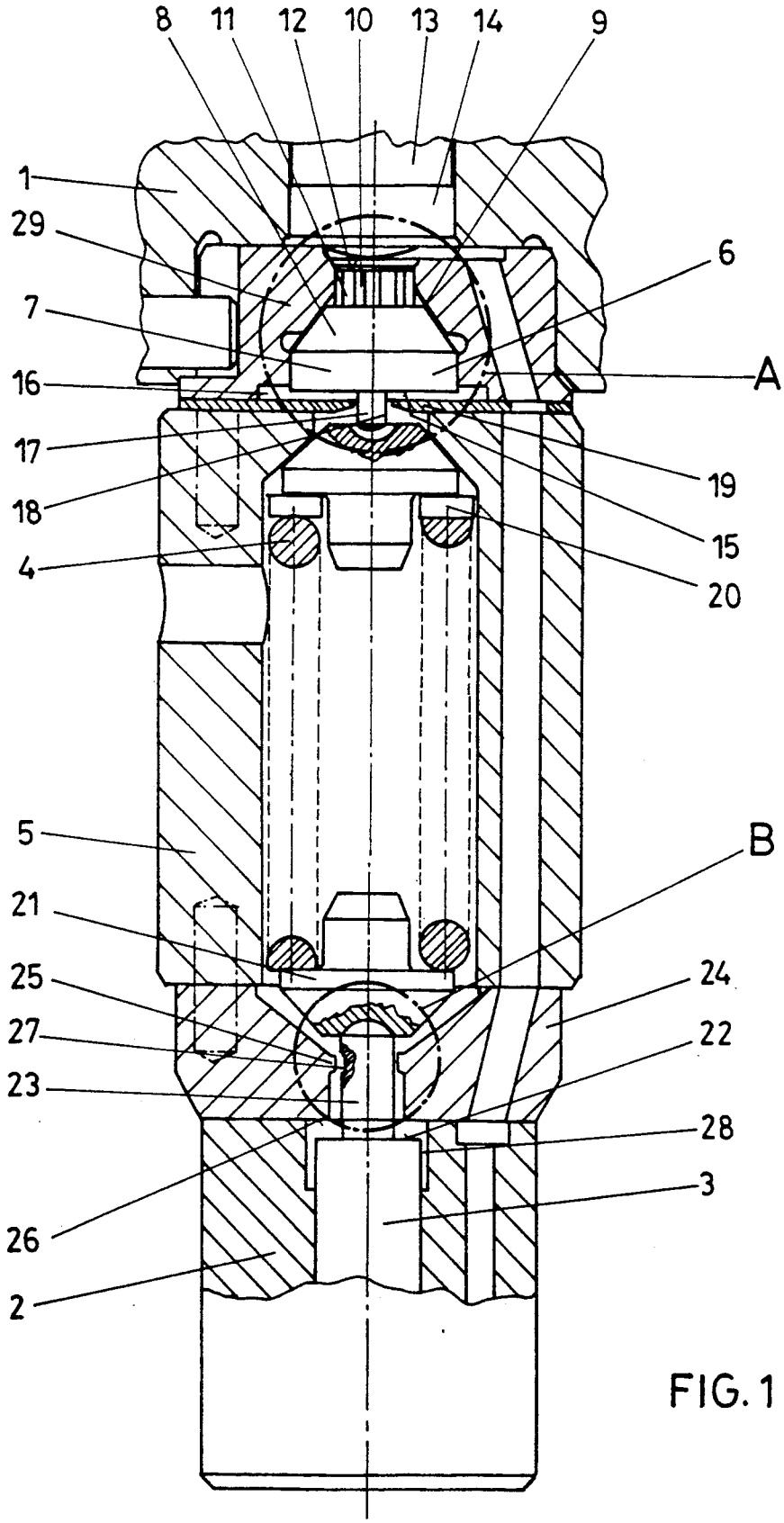

The invention relates to a fuel injection nozzle, particularly a pump jet with a nozzle plunger that is spring-loaded in the closing direction, in which the pressure chamber in front of the nozzle plunger seat is connected to an accumulator chamber limited by a spring-loaded shunting piston, whereby the shunting piston is stressed, on its end turned toward the accumulator chamber, by the pressure in a damping chamber that can be filled with fuel and has a pin that extends into a plate that limits that damping chamber and has an opening.

A fuel injection nozzle of this type, described in EP-A 277 939, makes possible the separation of the injection process into a pilot injection and a main injection. The very difficult problem of insuring a practical injection process under different operating conditions is solved in principle there by the damping of the shunting piston motion, but a few inconveniences still exist.

In a pump jet according to the state of the art, malfunctions in the injection process are observed relatively frequently. Sometimes the shunting piston opens too late, sometimes the pilot injection starts too late and supplies a quantity that is too low, sometimes it is omitted entirely. It is assumed that these malfunctions develop because of statistical variation in the pump supply pressure curve and in the dynamic opening pressure of the valve needle, e.g. if the valve needle has not opened yet when the dynamic opening pressure of the shunting piston is attained. An increase in this opening pressure would help, but is not possible, because the pilot injection would then last too long. This could only be achieved by a weaker damping of the shunting piston. However, because of that, the pilot injection quantity at low rpm would again be too low or at high rpm too high.

The latter is undesirable for reasons of combustion dynamics and it also occurs already without increasing the dynamic opening pressure of the shunting piston. At high speed and full throttle, the pilot injection continues on into the main injection without an injection pause.

Since when the nozzle plunger is raised, the volume in the pressure chamber increases suddenly, at low speed, the injection pressure first decreases so that with a low dynamic opening pressure of the shunting piston for the reasons named above, the pilot injection quantity is too low.

To optimize the combustion curve, however, it is desireable that the pilot injection quantities are as close as possible to equal at all engine speeds and load conditions and the duration of the pilot injection and the injection pause in degrees crankshaft is as close as possible to equal at all engine speeds.

These ideal conditions are described as the combustion process in DE-OS 37 35 169, but without any information on realizing them.

The goal of the invention is now to further develop an injection nozzle of the type mentioned at the beginning that improves response speed and dynamic behavior. In particular, the version according to the invention should assure that a secure function is maintained by moving the lowest possible weight of shunting piston and by rapid motions. To solve this task, the embodiment according to the invention basically consists of the fact that the cylindrical driving part of the shunting piston has a diameter to height ratio of 1:0.1 to 1:0.4, that the shunting piston has, on the side turned toward the accumulator chamber, a pin with variable cross section that extends into the limiting plate and that the shunting piston has a guiding extension with grooves, on its side turned towards the accumulator chamber.

Because of the fact that the dimensions of the shunting piston have been chosen to deviate from the known embodiments in such a way that only a relatively small height is provided in the stroke direction, the moved mass is significantly decreased. However, a shunting piston with this type of structure, almost disc shaped, would also have an increased tendency to slanted positions in the shunting piston guide path in the inside of the respective accumulator chamber as a result of rapid movements and thus it has been suggested according to the invention to provide an appropriate guide via which the desired injection curve can be exactly maintained by appropriate throttling of the shunting piston stroke, even with rapid and short strokes.

Because of the low construction height of the shunting piston, its inertial mass and thus its opening duration is decreased. In this way, the dynamic opening pressure of the shunting piston and the valve needle can be selected higher, whereby the pilot injection quantity between opening the valve needle and opening the shunting piston will be larger and less sensitive to scatter, without the entire pilot injection lasting longer because of it. This measure also works better in the desired way at lower speeds than at higher, since the dynamic opening pressure increases considerably via the speed. The increase of the statistically set opening pressure, on the other hand, has an approximately constant effect via the speed. Thus an ever lower increase of the injection quantity per time unit results, with the increasing dynamic opening pressure. In this way, the damping that affects the shunting piston can be decreased, whereby the duration of the pilot injection is decreased, above all at higher speed, which leads to an approximately equally long injection pause in degrees crankshaft angle in the predominant speed range of the pilot injection.

Finally, the low construction method of the shunting piston decreases not only its mass, but also the construction height of the entire pump jet, whereby this is always advantageous because of the installation conditions.

According to a preferred embodiment, the structure is designed in such a way that the diameter of the guide extension is smaller than the diameter of the thick edge of the shunting piston that is turned toward the accumulator chamber, which results in a particularly simple design for manufacturing technology.

The stroke-dependent structure of the throttle opening cross section is made in an advantageous way so that the pin has its greatest effective cross section at that point, which works together with the limiting plate at the beginning of its stroke, whereby it is assured that at the beginning of the shunting piston stroke, the greatest damping occurs, whereby the duration of the pilot injection is decreased above all at high speed and the injection pause is exactly maintained. A simply designed structure of this desired throttle characteristic and/or damping can be achieved by the fact that the limiting plate has a narrow throttle lip and/or throttle edge limited by two side surfaces that run at an acute angle to each other, whereby the adaptation to the currently desired uniformity can be improved in such a way that the pin has a chamfer or recess which, with the limiting plate, limits a throttle opening of different cross section along the length of the shunting piston stroke. An asymmetrical construction of the throttle cross section promotes the desired damping characteristic, whereby the design is preferably made in such a way that the recess has a triangular or trapezoid-shaped cross section and that the surfaces of the recess that are tipped toward the shunting piston long axis create a variable angle with the long axis. Particularly effective damping ratios can be achieved by the fact that the cross section surface of the throttle opening corresponds to 1/25 to 1/500, particularly 1/50 to 1/200 of the circular shaped base surface.

With consideration of the stroke-dependent damping of the shunting piston and the reduction of the moved masses, above all the quantity feed can be measured more exactly than with relatively inert and largely undamped movable shunting pistons. A further improvement of the division into pilot injection and main injection can be achieved in combination with more exact quantity supply of this type via a defined control of the stroke motion of the nozzle plunger. The further development is thus preferably made in such a way that the nozzle plunger, on its end turned toward the injection openings, extends into a second damping chamber that can be filled with fuel, and has a pressure pin that is surrounded with a stabilized projection that forms a stop for a shoulder of the nozzle plunger and that, during the nozzle plunger stroke movement, the stabilized projection defines a throttle opening that is connected to the damping chamber, which opens into a drain and/or another chamber. The throttling of the nozzle plunger stroke thus occurs in the opposite direction to the throttling of the shunting piston stroke, whereby a rapid opening and closing occurs in the pilot injection range, since the stroke of the nozzle plunger is limited by the throttling and/or damping of this first phase. A clearer improvement thus consists of the fact that, in the pilot injection range, first a rapid opening stroke with progressive damping is to be implemented, whereby the opening movement of the nozzle plunger is increased and simultaneously the path covered by the nozzle plunger during the opening stroke can be limited, whereby the closing motion can be initiated more rapidly. A further development of this type can be achieved by the fact that the throttle opening cross section between pressure pin and stationary wall of the damping chamber is variable depending on the nozzle plunger stroke. The stroke motion of the nozzle plunger is delayed and reduced by the throttle opening between nozzle spring chamber wall and pressure pin. With the smaller stroke, on one hand, the duration of the nozzle plunger closing is shorter, and on the other hand, less fuel is fed into the high pressure chamber by the retardation effect of the closing plunger, which leads to a large pressure drop in the pilot injection between opening the shunting piston and closing the valve needle, after the closing pressure is achieved. The reduction in injection quantity achieved in this way during the injection process works more effectively in the desired way at high engine speeds than at low engine speeds. This in turn permits an increase in the statistically adjusted opening pressure which causes an increase in the quantity injected between opening the valve needle and opening the shunting piston.

Figure 2:
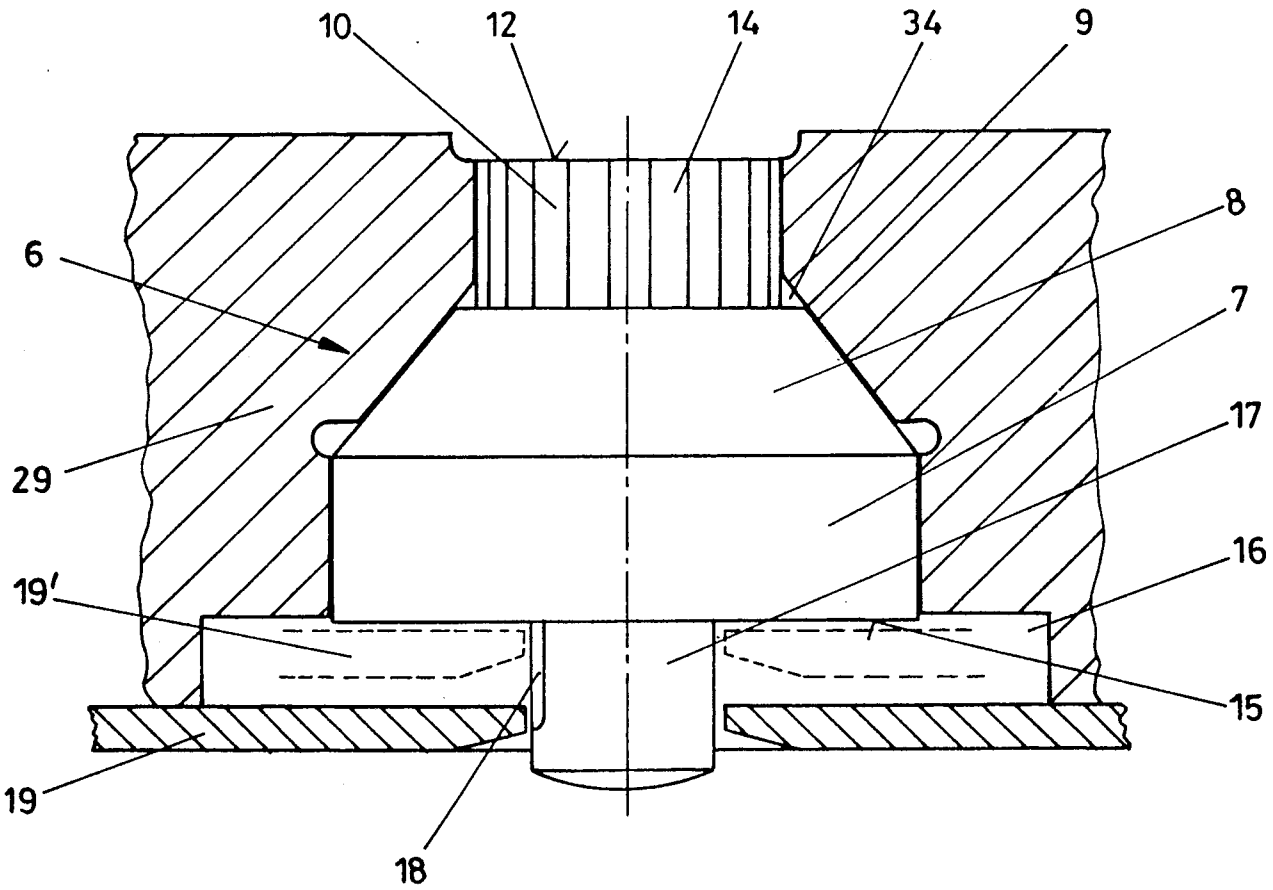
Figure 3:
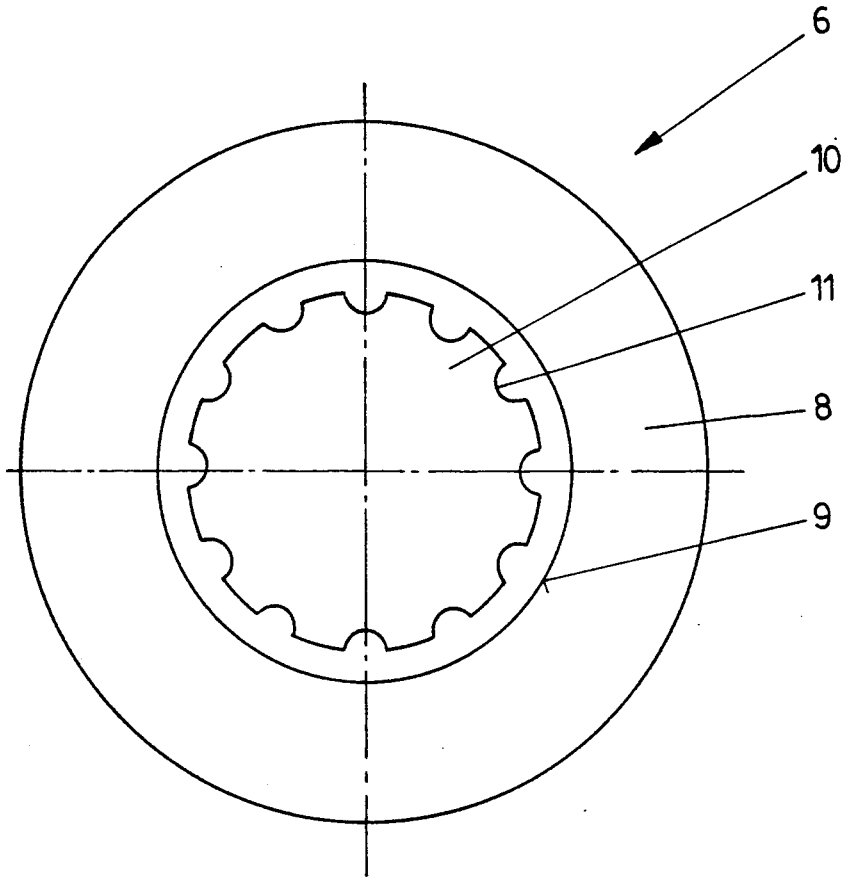
Figure 5:
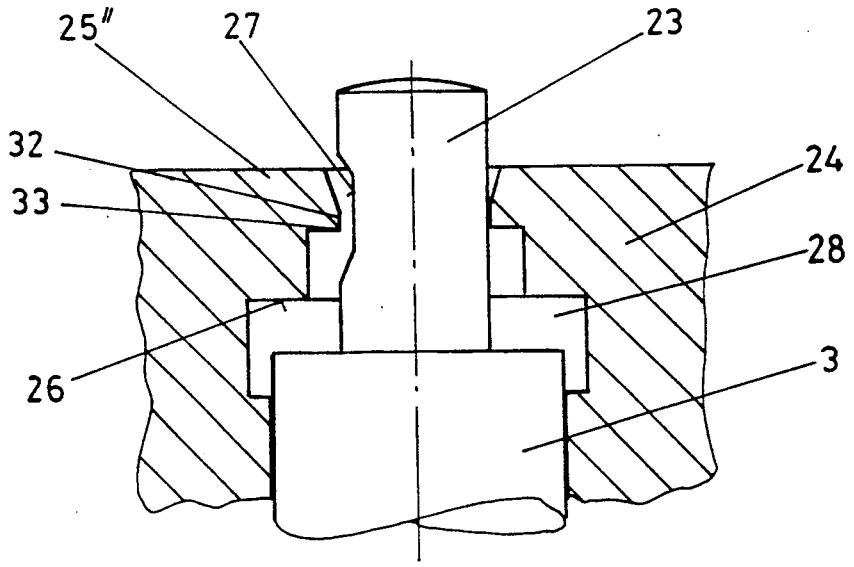
Figure 4:
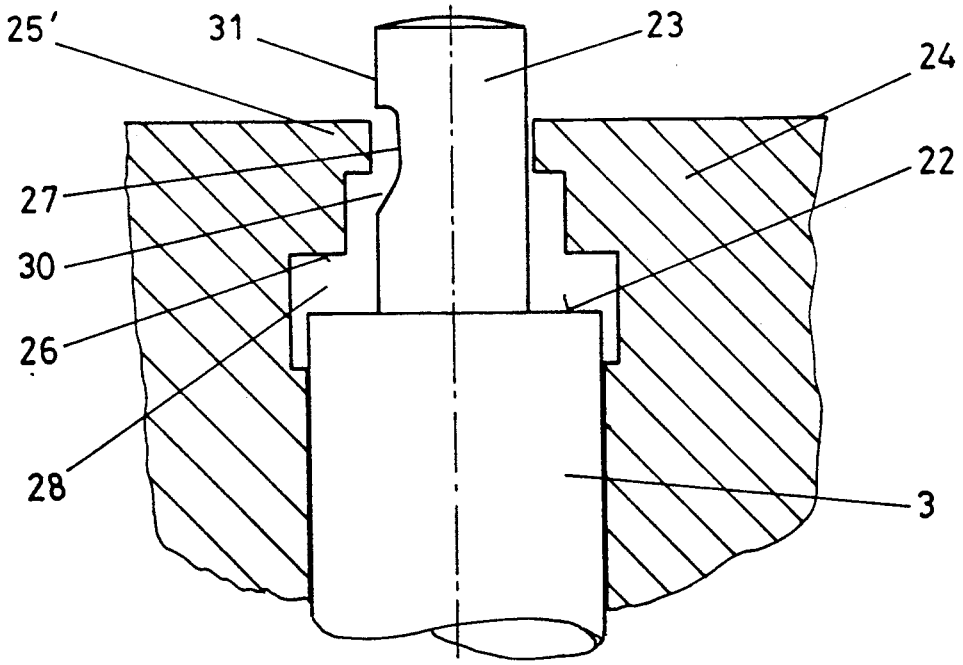

The invention is explained in more detail in the following using the embodiments of the fuel injection nozzle according to the invention schematically represented in the drawings. In these, FIG. 1 shows a longitudinal cross section through the center part of a fuel injection nozzle according to the invention, FIG. 2 Detail A of FIG. 1 enlarged and turned 90°;

FIG. 3 a top view of FIG. 2;

FIG. 4 Detail B of FIG. 1 enlarged; FIG. 5 a variation of Detail B and FIG. 6 injection rate curves at lower and at higher engine speed for a fuel injection nozzle according to the invention.

In the layout according to FIG. 1, 1 represents the pump piston bushing, 2 the nozzle body (partially cut away) with nozzle plungers 3, and 4 the nozzle plunger spring, which is mounted in a spring housing 5. 6 is the shunting piston and 29 the shunting piston bushing.

The shunting piston 6 consists of a cylindrical guide part 7, a sealing ball 8 and an extension 10 with grooves 11 and a front surface 12, which is turned toward the pressure chamber 14, on which pump piston 13 also works. The shunting piston 6 has a relatively low weight because of the height of cylindrical guide part 7 that is relatively low in relationship to the diameter. The low weight of the shunting piston 6 can be improved further by selection of a light material. Thus its mass inertia is low. The extension 10 can serve as a hydraulic damping element and is provided as an additional guide. As a damping element, it works because of the fact that, with increasing pressure in pressure chamber 14, the fuel goes through the grooves 11 into the accumulator chamber 34 and has an effect on control edge 9. As soon as the shunting piston starts into downward motion, the fuel must flow through the grooves 11, which then work as throttles. Since the throttle effect depends on the effective length of grooves 11, these decrease with sinking shunting piston 6.

Additionally to the damping by the shunting piston extension 10 provided with grooves, there is also a damping of the shunting piston 6 motion by cooperation of a pin 17 with the limiting plate and/or throttle plate 19.

The base surface 15 of the shunting piston 6 turned toward the accumulator chamber works in a damping chamber 16, which is limited by the shunting piston bushing 29 and the throttle plate 19 and is penetrated by pin 17 with a chamfer 18, which is part of the shunting piston 6. The chamfer 18 and the bore hole of throttle plate 19 form a throttle point that damps the downward motion of the shunting piston 6. More detail will be given later on the special structure of chamfer 18.

In spring housing 5, the nozzle plunger spring 4 creates a force connection between the upper and lower spring plates 20, 21. The lower spring plate 21 is supported on the nozzle plunger 3. Only the upper part of this is shown, which consists of a stop shoulder 22, on the top of which a pressure pin 23 is connected. This pressure pin 23 goes through an intermediate plate 24, that has a stable projection 26 on the bottom and on top a throttle lip 25. The stable projection 26 works together with the stop shoulder 22. The throttle lip 25 limits a throttle cross section with a chamfer 27 of pressure pin 23. With the upward motion of the nozzle plunger 3, the fuel is pressed out of the chamber 28 between throttle lip 25 and chamfer 27, whereby a damping of the nozzle plunger stroke motion can be achieved.

In the version in FIG. 1, the position of the chamfer 27 is selected in such a way that the damping effect is the lowest in the position shown at the beginning of the nozzle plunger motion and then increases, in order to result in a short stroke of the nozzle plunger 3 especially during the pilot injection. Further below, two variations are described for the design of this throttle point.

In FIGS. 2 and 3, the shunting piston 6 is shown enlarged. It can be seen that the guide extension 10 is designed with a smaller diameter than that of the control edge 9 and there is freedom in the selection of the diameter of extension 10.

From the base surface 15 of shunting piston 6, pin 17 with chamfer 18 extends into the throttle plate 19 (drawn with solid line, when the shunting piston 6 is located in its highest position). Here the chamfer is selected so that the damping effect in this position is greatest. If the shunting piston sinks, as is indicated by the dotted line position 19' of the throttle plate, the damping effect also decreases.

FIG. 4 shows a variation of the nozzle plunger stroke damping. The step- shaped throttle lip 25' is designed with a cylindrical inner edge, chamfer 27 of pressure pin 23 is asymmetrical and the transition 30 forms a sharp edge, while transition 31 is smooth. In this way, the throttle effect is dependent on the direction of movement and on the actual nozzle plunger stroke. During closing of the nozzle plunger, damping is not desireable. Because of the danger of cavitation of chamber 28, it can even cause damage.

In the variation in FIG. 5, the same effect is obtained with a modified version. The chamfer 27 of pressure pin 23 is basically a trapezoidal shape with end areas that are slanted differently and limited on one side by the plane 33 and on the other by the ball surface 32.

The throttle cross sections shown in FIGS. 4 and 5 can be designed analogously for damping the shunting piston 6. Instead of the trapezoidal chamfer 27, for example, it can also be used in a basically triangular design. The cross section surfaces of the throttle locations thus are maximum 1/25 and minimum 1/500 of the base surface 15 and/or the surface of shoulder 22. In the construction of the throttle points for damping the movement of shunting piston 6 and nozzle plunger 3, particularly Details A and B, there is great freedom in the scope of the invention, to adjust the throttle behavior by easy technical measures and to make it dependent on the stroke and/or on the direction of movement. It is naturally also possible to give pressure pin 3 and pin 17 of the shunting piston a shape with rotational symmetry, leaving off the chamfer 27.

Figure 6:
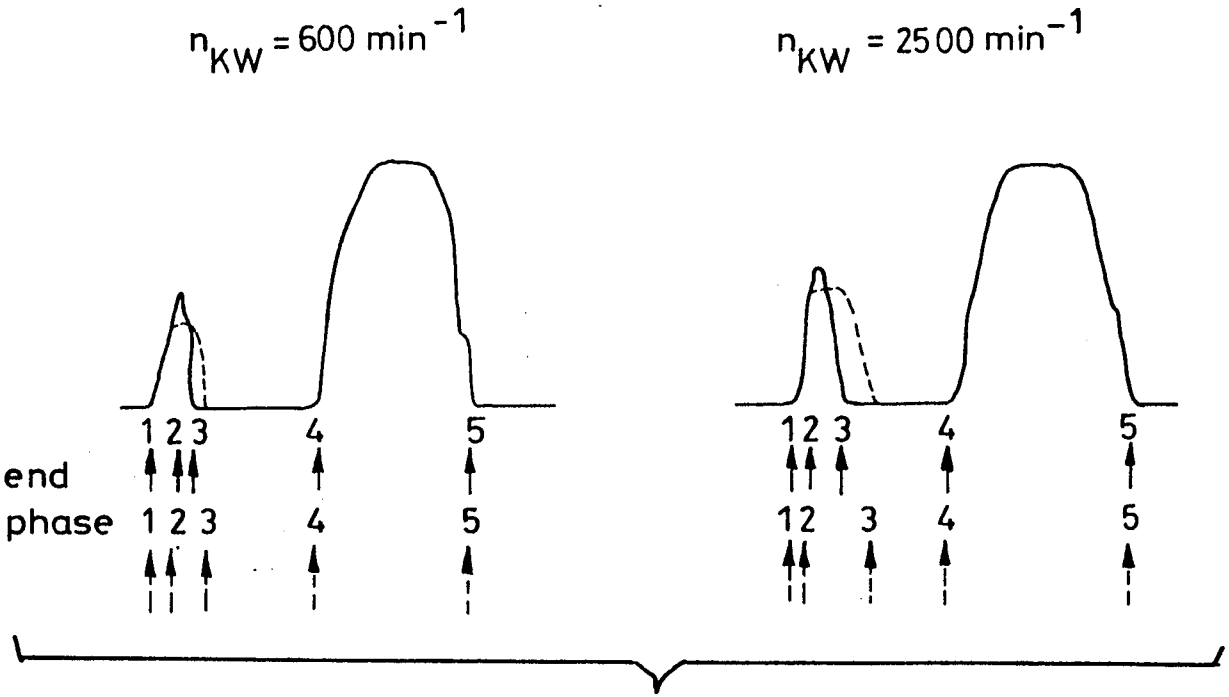

In the following, using the diagrams in FIG. 6, comparisons will be made of the injection quantity curves in a pump jet at idle and at high rpm according to the state of the art (dotted line) and a pump jet according to the invention. The injection process is divided into several phases:

- Phase 1: Beginning of the pump stroke until the dynamic opening pressure of the nozzle plunger is attained, no supply,
- Phase 2: end of phase 1 until the dynamic opening pressure of the shunting piston is achieved,
- Phase 3: end of phase 2 until the nozzle plunger closes,
- Phase 4: injection pause, until the dynamic opening pressure of the nozzle plunger is achieved again,
- Phase 5: the subsequent main injection.

At low engine speed, the main difference between the state of the art and the object of the invention is in Phase 3. It can be seen that with similar form of the pressure curve, the drop in quantity occurs earlier and more steeply, which would lead to a slight reduction in pilot injection quantity. The higher dynamic opening pressure that is now possible with the lighter shunting piston increases the quantity to the original volume and additionally decreases the cyclic scatter of the pilot injection curve.

At high engine speed, the difference is also in Phase 3. Because of the steeper pressure drop, the decrease in injection quantity is steeper, whereby a significant reduction in pilot injection quantity is achieved. The combination with the lower shunting piston weight and its thereby higher dynamic opening pressure leads, because of a decreasing shunting piston damping (which according to the state of the art was only required in order to assure a sufficient pilot injection quantity at low speed), to a short pilot injection and a subsequent definite injection pause. This effect is further enhanced by the damping that can be changed via the stroke.

The measures according to the invention thus lead to the desired injection curve with the particularly difficult dynamic conditions of a pump jet for high pressure injection and high speeds.

Under the tolerances that can be achieved for the production of precision parts of fuel injection nozzles and the justifiable leakage rates for the sealing of the low pressure side, the height of the shunting piston 6 can be decreased to up to 10% of the diameter with suitable guiding by the guiding extension 10. Depending on the selected production quality, a reduction of the shunting piston 6 construction height by up to 90% of the diameter is possible. Because of this, a reduction in the shunting piston 6 weight by up to 70% can be achieved, whereby an increase results in the maximum storage rate because of higher acceleration of shunting piston 6 at the same pressure difference between damping chamber 16 and pumping chamber 14.

Since the pin 17 has a variable cross section, it is possible to further change the speed of shunting piston 6 with a given curve of the effective pressure difference between pump cylinder 13 and throttle point formed upstream by the chamfer 18. Because of the fact that pin 17 has its greatest effective cross section at the point that cooperates with the limiting plate 19 at the beginning of its stroke, an increasingly fast opening movement of the shunting piston and a rapid ending of the pilot injection connected with it is made possible. With progressive movement of shunting piston 6 the remaining throttle effect causes a corresponding damping of the motion, so that in spite of the low weight of the shunting piston, vibration of same can be safely prevented. Thus overall a faster dynamic response behavior of the shunting piston results, which is particularly made possible by the weight reduction, whereby friction forces opposite the stroke direction are additionally decreased by the basically disc-shaped construction of the shunting piston.

As already mentioned above, the additional damping of the stroke motion of the nozzle plunger for supporting the improved response behavior of the shunting piston, which has already been achieved by the shunting piston design, is used to divide the injection into a pilot injection and main injection.

I claim:

1. A fuel injection nozzle, comprising:

a pressure chamber;

an accumulator chamber in fluid communication with said pressure chamber;

a spring-loaded shunting piston for limiting the volume of said accumulator chamber, said shunting piston having first and second ends and a cylindrical guide portion, said first end facing said accumulator chamber and including a guide extension with grooves, said cylindrical guide portion having a diameter to height ratio of 1:0.1 to 1:.04, said second end of the shunting portion including a pin of variable cross section which protrudes into a throttle opening of a plate, said plate defining a damping chamber adapted to be filled with fluid whereby the shunting piston is influenced by pressure in said damping chamber.

2. A fuel injection nozzle according to claim 1, wherein said first end of said shunting piston has a sealing edge having a diameter larger than a diameter of said guide extension.

3. A fuel injection nozzle according to claim 1 or 2, wherein said pin of variable cross section has its largest effective cross section at a point that cooperates with said plate at the beginning of said pin's stroke so as to provide rapid opening movement of said shunting piston.

4. A fuel injection nozzle according to claim 3, wherein said plate includes a narrow throttle lip at said throttle opening defined by two side surfaces disposed at acute angles to each other.

5. A fuel injection nozzle according to claim 3, wherein said pin includes a recess which in cooperation with the throttle opening in said plate, provides a passage of variable cross section along the length of the pin during a stroke of the shunting piston.

6. A fuel injection nozzle according to claim 5, wherein said recess has a triangular-shaped cross-section and wherein a surface of said recess disposed toward a longitudinal axis of said shunting piston forms a variable angle with said axis.

7. A fuel injection nozzle according to claim 1 or 2, wherein the cross-section between said pin and the plate at said throttle opening is 1/50 to 1/200 of the area of said second end of said shunting piston.

8. A fuel injection nozzle according to claims 1 or 2, further comprising:

a spring-loaded nozzle plunger protruding into a second damping chamber adapted to be filled with fuel, said plunger being joined to a second pressure pin passing through an opening in a stabilized projection which forms a stop shoulder for said nozzle plunger, said stabilized projection opening, together with said second pressure pin defining a throttle opening to said second damping chamber during the stroke of said nozzle plunger.

9. A fuel injection nozzle according to claim 8, wherein the cross section of said throttle opening to said second damping chamber is variable, during the nozzle plunger stroke.

* * * * *